US006536587B2

(12) United States Patent
Wächter

(10) Patent No.: US 6,536,587 B2
(45) Date of Patent: Mar. 25, 2003

(54) CIGARETTE PACK AND METHOD OF MAKING AND RATING THE SAME

(75) Inventor: Michael Kleine Wächter, Lankau (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 10 days.

(21) Appl. No.: 09/816,118

(22) Filed: Mar. 26, 2001

(65) Prior Publication Data

US 2001/0023833 A1 Sep. 27, 2001

(30) Foreign Application Priority Data

Mar. 25, 2000 (DE) ..... 100 15 071

(51) Int. Cl.[7] ..... A24F 15/00

(52) U.S. Cl. ..... 206/254; 206/268; 206/273; 206/459.5; 206/831

(58) Field of Search ..... 206/254, 264, 206/268, 271, 273, 459.1, 459.5, 831

(56) References Cited

U.S. PATENT DOCUMENTS 1,816,835 A * 8/1931 Fischer ..... 206/264
1,836,228 A * 12/1931 Dryer ..... 206/264
1,991,412 A * 2/1935 O'Connor ..... 206/264
2,009,835 A * 7/1935 Burke ..... 206/264
2,065,422 A * 12/1936 Bolt ..... 206/264
2,325,022 A * 7/1943 Aaegerter ..... 206/264
3,245,525 A * 4/1966 Shoemaker ..... 206/249
5,097,948 A * 3/1992 Campbell ..... 206/268
5,160,024 A * 11/1992 Evers ..... 206/264
5,515,965 A * 5/1996 Boldrini et al. ..... 206/264
5,788,066 A * 8/1998 Focke et al. ..... 206/298
5,931,292 A * 8/1999 Focke et al. ..... 206/264
6,138,823 A * 10/2000 Focke et al. ..... 206/259

* cited by examiner

*Primary Examiner*—Shian Luong
(74) *Attorney, Agent, or Firm*—Venable, LLP.; Robert Kinberg

(57) ABSTRACT

A one-piece paper or cardboard blank is converted into a hinged-lid cigarette pack wherein a box-shaped housing has a rear wall connected to the rear wall of a cover pivotable to and from a closed position in which it closes an opening at the top of the housing. The cover and the housing include sections which are respectively connected to the main portions of the housing and cover by weakened portions and are adjacent each other in the closed position of the cover. An adhesive revenue label or coupon is bonded to the outer sides of the sections and is manually or mechanically removed from the cigarette pack, with or relative to the sections, if a visual or automatic inspection of the freshly made cigarette pack reveals that its condition does not meet a predetermined standard.

21 Claims, 3 Drawing Sheets

Fig. 1a
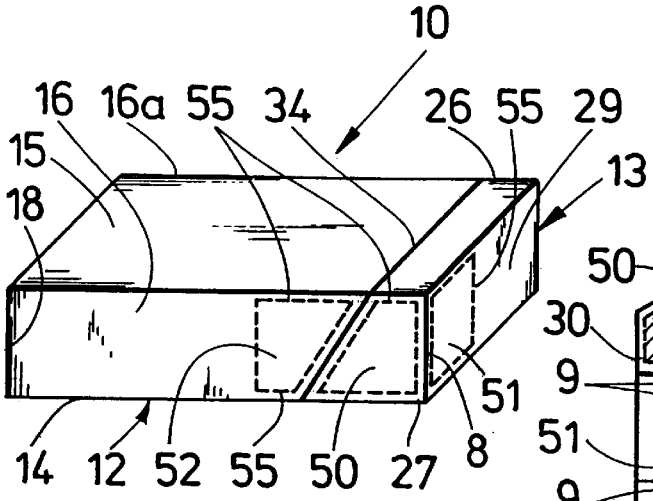
Fig. 1b
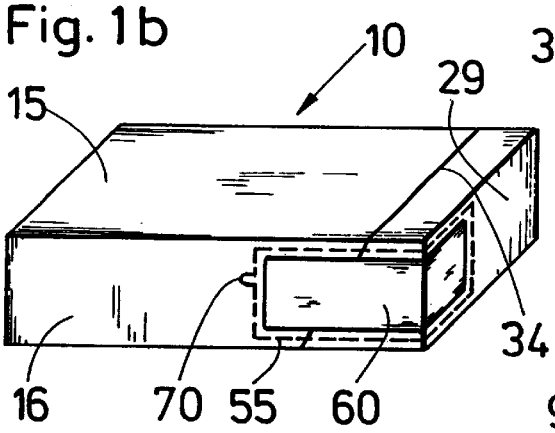
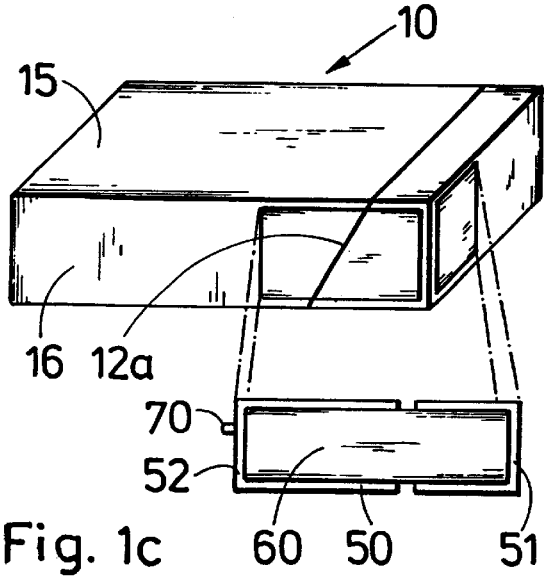
Fig. 1c
Fig. 2
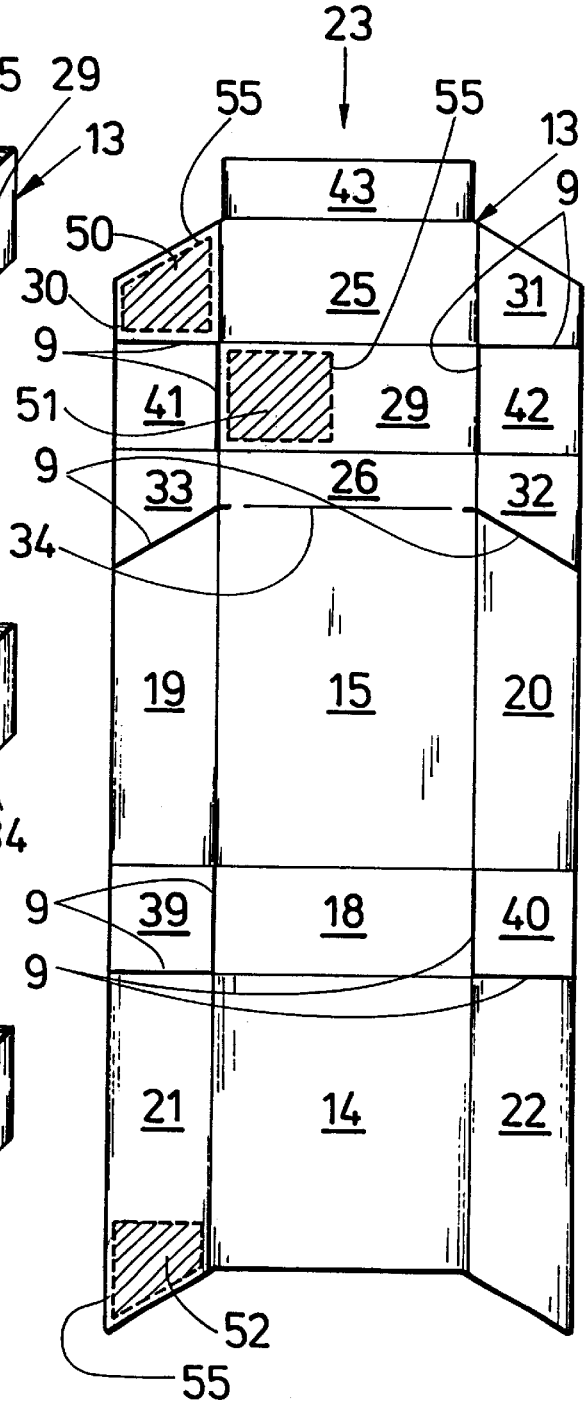

CIGARETTE PACK AND METHOD OF MAKING AND RATING THE SAME

CROSS-REFERENCE TO RELATED CASES

The present application claims the priority of the commonly owned pending German patent application Serial No. 100 15 071.3 filed Mar. 25, 2000. The disclosure of the above-referenced German patent application, as well as that of each US and foreign patent and patent application identified in the specification of the present application, is incorporated herein by reference.

BACKGROUND OF THE INVENTION

The present invention relates to improvements in receptacles or containers, and more particularly to improvements in box-shaped receptacles which are or which can be utilized for the confinement of discrete (such as rod-shaped) products, e.g., arrays of cigarettes cigars cigarillos and other rod-shaped smokers' products. Still more particularly, the invention relates to improvements in the making and manpulation of receptacles of the type known as hinged-lid packs which are popular, and which are becoming even more popular for the confinement of arrays of rod-shaped smokers' products (hereinafter called cigarettes but intended to embrace all kinds of rod-shaped smokers' products).

Hinged-lid cigarette packs are described and illustrated, for example, in published German patent application Serial No. 196 43 411 A1. A pack of the type described in this published patent application comprises a cigarettes-confining component or member (hereinafter called housing or housing member) having an opening which affords access to confined cigarettes, a cover member or lid which has a rear wall or panel-pivotable relative to the rear wall or panel of the housing, and an insert (namely a so-called collar) which is inserted into the housing and surrounds three sides of the opening. The outer side of the collar is engaged by the front wall and by the two sidewalls of the lid when the latter is maintained in the closed position. In order to enhance the appearance of such packs, the housing and the lid are provided with windows. That side of each window which confronts the contents of the pack is closed. The front wall of the collar and the customary inwardly folded reinforcing flap of the front wall of the lid are utilized to carry printed matter.

It is customary, practically all over the world, to impose taxes upon smokers' products. In order to furnish evidence that the required taxes or duties upon the contents of a cigarette pack have been paid, each such pack normally bears a revenue label or coupon which is bonded to the cigarette pack by a suitable adhesive. Since a cigarette packing machine invariably turns out a certain number of rejects, and since a modern packing machine turns out huge quantities of cigarette packs, it is desirable and customary to remove the revenue labels or coupons (hereinafter called labels or bands for short), to gather the removed labels, and to obtain refunds or credits from the relevant governmental agency for each returned label. Such procedure is followed by the manufacturers of cigarette packs in connection with each pack which is damaged, smudged and/or otherwise adversely affected to an extent which renders it unsuitable for sale to distributors and/or to the ultimate consumers. All in all, the recovered labels constitute a valuable property which can greatly affect the profits of the manufacturers of cigarette packs. For example, a so-called COMPAS cigarette packer (distributed by the assignee of the present application) can turn out in excess of 500 cigarette packs per minute. Thus, even if the percentage of rejects per hour, per shift or per day is low or extremely low, the total number of rejects is sufficiently high to warrant the recovery of each and every revenue label that was applied to a defective cigarette pack.

A problem which still awaits an acceptable solution is to satisfactorily (such as completely and rapidly) remove labels from defective packs, i.e., to rapidly separate labels from cigarette packs which constitute rejects (or which are not suitable for shipment to distributors and/or consumers for any other reason) and to separate the labels in a manner and in a condition acceptable for presentation to the authorities in charge of properly crediting the taxes paid or expected to be paid for the contents of cigarette packs already relieved or about to be relieved of their revenue labels.

The above problem is attributable to the fact that, in accordance with the presently prevailing technique, labels are pasted directly onto the cigarette packs; this necessitates resort to a time-consuming undertaking involving the separation of adhesively affixed labels from the packs because a damaged (such as torn or fragmentized) label might not be acceptable for refund and also because detachment of labels from their packs can become too expensive if it takes up a relatively long interval of time.

OBJECTS OF THE INVENTION

An object of this invention is to provide a label-bearing cigarette pack which is constructed and assembled in such a way that the label can be separated from its housing and/or from its cover in a time-saving and convenient manner.

Another object of the present invention is to provide a pack which is constructed and assembled in such a way that the detachment of the label is more likely to involve damage to the receptacle for cigarettes than to the label.

A further object of the invention is to provide novel and improved components which constitute the housing and the lid of a cigarette pack.

An additional object of the invention is to provide a novel and improved hinged-lid pack for the confinement of cigarettes or other rod-shaped articles of the tobacco processing industry.

Still another object of the invention is to provide a novel and improved method of assembling the housing and the lid of a hinged-lid pack with a revenue label, coupon or the like.

A further object of the instant invention is to provide a method which renders it possible to ensure rapid, convenient and reliable detachment of revenue labels and like parts from the housing and cover of a hinged-lid pack.

Another object of the invention is to provide a method which renders it possible to separate the label from the hinged-lid pack in a condition which is acceptable for presentation to relevant authorities to ensure invariable recovery of the value represented by the label.

An additional object of the present invention is to provide a hinged-lid pack wherein the properly applied revenue label or coupon contributes to the eye-pleasing appearance of the finished product.

Still another object of the invention is to provide a novel and improved blank which can be converted into a hinged-lid pack adapted to bear a revenue label or the like in a manner ensuring convenient and rapid separation of the label if such recovery becomes desirable or necessary.

A further object of the invention is to provide a simple and inexpensive blank which can be fed into a cigarette packing machine in a condition ready for conversion into a hinged-lid cigarette pack without any, or without appreciable, further treatment (such as slitting, severing, creasing, folding or the like) prior to confinement of an array of rod-shaped articles therein and/or prior to the application of a label to its exterior.

Another object of the instant invention is to provide a novel and improved machine for the confinement of rod-shaped smokers' products in hinged-lid packs and the like.

SUMMARY OF THE INVENTION

One feature of the present invention resides in the provision of a receptacle for smokers' products which comprises a housing member having an opening and a cover member. Each of these members includes a main portion, at least one section of which is separable from the respective main portion, and breakable means for connecting the main portion with the respective at least one section. The main portion is and the sections have first tearing strengths and the connecting means have lesser second tearing strengths. The improved receptacle further comprises means for attaching the two members to each other for movement of the cover member between first and second positions in which the cover member respectively closes and exposes the opening, and a pad which overlies the aforementioned sections at least-in the first position of the cover member. The pad is separable from the main portions together with the sections upon breakage of the connecting means.

The attaching means can include a hinge and each of the two main portions can include a front wall and a rear wail. The hinge can be positioned and Designed to pivotably connect the rear walls of the two members to each other.

The pad preferably consists of a single sheet of strip material one side of which is coated with a glue or another suitable adhesive substance.

The position of the at least one section of the housing member can be selected in such a way that this section is adjacent the at least one section of the cover member, at least in the first position of the cover member.

The connecting means of the cover member can include at least one end portion which is immediately adjacent an end portion of the connecting means of the housing, at least in the first position of the cover member.

At least a portion of the attaching means can serve to articulately connect the at least one section of the housing member with the at least one section of the cover member.

Each of the two main portions can include two spaced apart parallel sidewalls and at least a portion of at least one section of the at least one member can be of one piece with one of the sidewalls, at least in the unbroken condition of the connecting means adjacent the at least one portion of the at least one section.

The main portion of the cover member can include a top wall and a rear wall, and at least a portion of the at least one section of the cover member can be coplanar with one of the aforementioned walls, at least in the first position of the cover member and in unbroken condition of the respective connecting means.

The main portion of the cover member can include a top wall and a sidewall, and the at least one section of the cover member can include first and second parts which are respectively coplanar with the top wall and the sidewall, at least in the unbroken condition of the respective connecting means.

The pad is or can be bonded to the aforementioned sections; such pad can include a revenue label, a coupon or the like.

The dimensions of the pad can be selected in such a way that it overlies at least a portion of at least one of the connecting means.

Another feature of the present invention resides in the provision of a method of making and manipulating a substantially box-shaped receptacle for smokers' products, especially a hinged-lid pack for arrays of cigarettes or other rod-shaped articles of the tobacco processing industry. The improved method comprises the steps of providing a blank of foldable sheet material with at least one weakened portion which at least partially surrounds at least one section of the blank, and thereupon converting the blank into a receptacle wherein a cover member is attached to a housing member for movement between closed and open-positions in which the cover member respectively overlies and exposes an opening of the housing member and wherein the at least one section is accessible at the exterior of at least one of the two members. The improved method further comprises the steps of bonding a one-piece pad to the at least one section of the converted blank in the closed position of the cover member, thereupon inspecting the quality of the receptacle, and detaching the pad from the receptacle, without appreciably damaging the pad, when the inspecting step reveals that the condition of the receptacle fails to meet a predetermined standard.

The detaching step can include separating the pad from the receptacle together with the at least one section.

The pad can include or constitute at least one revenue label or coupon, and the detaching step can be carried out by hand or mechanically (i.e., with a machine, tool or implement).

The converting step can include transforming the blank into a receptacle wherein the at least- one section forms part of the housing member as well as of the cover member and is preferably positioned in such a way that the receptacle can be opened (in order to afford access to the contents of the receptacle) only upon detachment of the label (except upon destruction of the label to an extent which might render the label unsuitable for presentation to the authorities for a refund).

The bonding step can include causing the pad to overlie the entire at least one section as well as a portion of the housing member and/or cover member adjacent the at least one section.

The novel features which are considered as characteristic of the invention are set forth in particular in the appended claims. The improved receptacle itself, however, both as to its construction and the modes of assembling and utilizing the same, together with numerous additional important and advantageous features and attributes thereof, will be best understood upon perusal of the following detailed description of certain presently preferred specific embodiments with reference to the accompanying drawings.

BRIEF DESCRIPTION OF THE DRAWINGS

FIG. 1*a* is a perspective view of a closed hinged-lid cigarette pack as it appears upon completion of conversion of a blank of paper, cardboard or the like, with weakened portions provided in two confronting sidewalls of the housing and cover as well as in the top wall of the cover;

FIG. 1*b* illustrates the hinged-lid pack of FIG. 1*a* but with a label or pad adhesively secured to selected sections of the housing and cover;

FIG. 1*c* illustrates the structure of FIG. 1*b* but with the label and the sections detached from the main portions of the housing and cover and the label flattened;

FIG. 2 is a plan view of a blank which can be converted into a hinged-lid cigarette pack of the type shown in FIG. 1*a;*

DESCRIPTION OF PREFERRED EMBODIMENTS

Figure 3A:
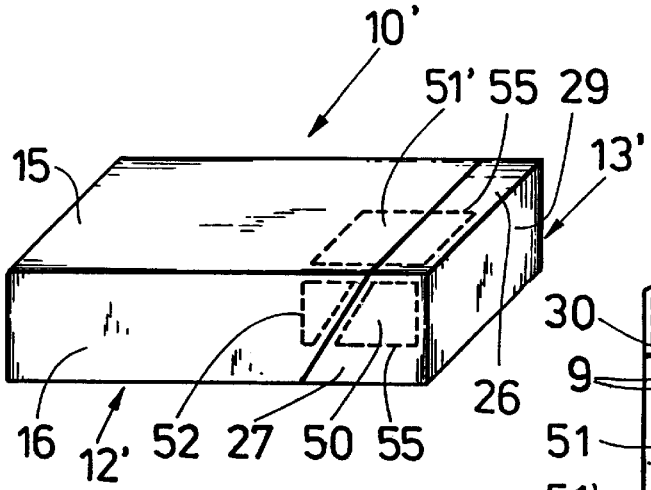
FIG. 3*a* is a perspective view of a hinged-lid cigarette pack having weakened portions provided in the rear walls and in one sidewall of the housing and cover.

FIG. 1*a* shows a partly finished hinged-lid receptacle or pack 10 having a box-shaped housing member or housing 12 of one piece with a cover member or lid (hereinafter called cover) 13. The housing 12 has a rear wall or panel 15 which is pivotably connected to the rear wall or panel 26 of the cover 13 by a hinge 34 constituted by a straight weakened (such as compacted) portion of a converted one-piece paper or cardboard blank 23 shown in FIG. 2. The rear wall 15 forms part of a main portion of the housing 12, and such main portion further comprises a front wall or panel 14 which is spaced apart from and is parallel with the rear wall 15, a bottom wall or panel 18 which is disposed between and is normal to the walls 14, 15, and two sidewalls or panels 16, 16*a*.

The sidewall 16 includes two elongated flaps 19, 21 which overlie and are or can be bonded to each other, and the sidewall 16*a* also includes two elongated flaps 20, 22 which overlie and are or can be bonded to each other. Two rectangular or square tucks 39, 40 overlie the adjacent portions of the inner side of the bottom wall 18 when the conversion of the blank 23 into the receptacle or pack 10 is completed. Those (free) end portions of the walls 14, 15, 16, 16*a* which are remote from the bottom wall 18 define an opening 12*a* (see FIG. 1*c*) serving to afford access to the cigarettes confined in the housing 12 when the cover 13 is pivoted (at 34) from the closed position (shown in FIGS. 1*a* to 1*c*) to the open position.

The customary (substantially U-shaped) collar of the finished cigarette pack 10 has three panels partially overlapped by those portions of the walls 16, 15, 16*a* which are adjacent the opening 12*a*, and the outer sides of the exposed portions of the panels of the collar are frictionally engaged by the adjacent portions of the inner sides of the front wall or panel 25 and two sidewalls 27 of the main portion of the cover 13. The front wall is reinforced by a relatively narrow elongated reinforcing strip 43 (see FIG. 2) which is initially pivotable (at 43*a*) relative to the wall 25 but overlies a portion of the inner side of the wall 25 when the conversion of the blank 23 into the housing 12 and cover 13 is completed. The sidewalls 27 of the cover 13 comprise pairs of overlapping trapeziform tucks 30, 33 and 31, 32 which are bonded or otherwise reliably affixed to each other. Still further, the cover 13 comprises two square or rectangular tucks 41, 42 which overlie the adjacent portions of the inner side of the top wall 29. The tuck 33 is omitted in FIG. 1*c* to show the opening 12*a*.

The cover 13 is provided with weakened connecting means or portions 55 in the form of lines or rows of perforations, short slits, dashes of compressed material of the blank 23 obtained by scoring, notching, stamping and/or analogous treatment of the latter. The connecting means 55 of the cover 13 bound two sections 50, 51 which are respectively provided in the tuck 30 and the top wall 29 so that they are adjacent each other and make a right angle when the conversion of the upper part of the blank 23 shown in FIG. 1 into the cover 13 is completed.

The housing 12 of the pack 10 shown in FIGS. 1*a* to 1*c* is provided with a single square or rectangular connecting portion 55 which surrounds a section 52 forming part of the flap 21, i.e., of the sidewall 14 of the main portion of the housing 12. The section 52 is adjacent the section 50 when the cover 13 is maintained in the closed position.

The manner in which the blank 23 is scored to exhibit the numerous fold lines (e.g., between the walls 25 and 29, 29 and 26, 26 and 15, wall 15 and flaps 19, 20, wall 14 and flaps 21, 22 and so forth) is known in the art of making hinged lid packs for cigarettes and the like. The blank 23 is further provided with slits 9 (namely between the tuck 39 on the one hand and the flap 21 and wall 18 on the other hand, between the tuck 40 on the one hand and the flap 22 and wall 18 on the other hand, between the tucks 32, 33 on the one hand and the flaps 20, 19 on the other hand, between the tuck 41 on the one hand and the wall 29 and tuck 30 on the other hand, as well as between the tuck 42 on the one hand and the wall 29 and tuck 31 on the other hand) which are necessary to permit conversion of the blank 23 into the pack 10.

The flaps 19, 21 and 20, 22 are respectively bonded to each other. The same applies for the tucks 30, 33 and 31, 32 as well as for the front wall 25 and the strip 43.

The character 60 denotes an elongated one-piece flexible strip-shaped pad which can constitute a revenue label or coupon (hereinafter called label) and is affixed (preferably by a film of a suitable adhesive) to the walls 16, 29 so that it overlies at least the major portions of the sections 50, 51 and 52. The label 60 is normally intact only as long as the cover 13 dwells in the closed position, i.e., prior to initial opening of the finished pack 10. Thus, the label 60 must be destroyed if one is to gain access to the contents of the pack.

The dimensions of the label 60 which is shown in FIGS. 1*b* and 1*c* are selected in such a way that, save for those parts of the connecting means 55 which are adjacent the edge 8 between the: walls 29, 27 of the cover 13 and which are adjacent the walls 16, 27 (reference should be had to FIG. 1*a*), the connecting means 55 is not overlapped by the label. Thus, if the non-overlapped portions of the connecting means are destroyed (broken or torn), the label 60 can be readily separated from the housing 12 as well as from the cover 13 to thus afford access to the contents of the hinged-lid pack 10.

FIG. 1*a* shows the pack 10 in the closed position of the lid 13 and prior to the application of the label 60 to the sections 50 to 52. FIG. 1*b* shows the label 60 in the position in which it prevents pivoting of the cover 13 to the open position; this is the condition of a satisfactory pack which is ready to be sold to a smoker or which is ready to be opened by a smoker. FIG. 1*c* shows the label 60 upon separation from the main portions of the housing 12 and cover 13 in the intact condition, i.e., ready for storage preparatory to turning in to the taxing authority for a refund or credit. The three sections 50, 51 and 52 continue to adhere to the separated intact label 60; such sections may but need not always be separated from the label 60 before the latter is turned in for a refund or credit. Such separation of the label 60 is or can be carried out when a visual or automatic inspection of the finished pack (FIG. 1*b*) reveals the presence of one or more defects in the interior and/or at the exterior of the enclosure including the housing 12 and the cover 13. It is also possible to detach the label 60 (with or without the sections 50–52) when a monitoring of the blank during conversion into a hinged-lid pack 10 (i.e., during draping around an array of cigarettes in a cigarette packing machine) reveals the presence of one or more defects warranting segregation of the respective pack from satisfactory hinged-lid packs.

Separation of the label 60 from the main portions of the housing 12 and cover 13 of the pack 10 shown in FIG. 1*c* can be simplified by depressing the section 50, 51 and/or 52 so that some of the weakened connecting portions 55 break and permit convenient removal of the label 60 with one, two or all three sections. Such mode of detaching the label 60 from the main portions of the housing 12 and cover 13 is highly likely to result in separation of the label 60 together with the sections 50 15 to 52. An advantage of joint detachment of the label 60 and the sections 50–52 is that the adhesive at the underside of the label need not be exposed, i.e., the label is highly unlikely to adhere to one or more parts (such as satisfactory packs 10) which could be contaminated as a result of contact with adhesive.

The blank 23 of FIG. 2 is an elongated portion of a continuous web or strip (not shown) of paper, cardboard or any other suitable wrapping material. Separation of the illustrated blank 23 from a continuous strip or web can take place simultaneously with cutting of the blank at 9 and, if desired, simultaneously with the making of various fold lines (such as the hinge 34) as well as with the making of weakened connecting portions 55.

FIG. 2 shows one presently preferred configuration of a blank 23 which can be converted into the hinged-lid pack 10 of FIG. 1 ready to receive a one-piece label 60. The exact sequence of separating the blank 23 from the leader of a continuous running web or strip of wrapping material, of providing the blank with slots 9, of providing the blank with linear weakened portions 34, etc., of providing selected parts of the blank 23 with weakened connecting sections or portions 55 and/or of converting the blank 23 into the pack 10 can be selected and varied within a wide range without departing from the spirit of the present invention.

All such parts of the hinged-lid pack 10' (e.g., a cigarette pack) of FIGS. 3*a*, 3*b* and 3*c* which are identical with or plainly analogous to the corresponding parts of the pack 10 of FIGS. 1*a* to 1*c* are denoted by similar reference characters and will be described again only to the extent which is necessary to facilitate the understanding of differences between the packs 10 and 10'. This also applies for the blank 23 of FIG. 2 and for the blank 23' which is shown in FIG. 4 and which can be converted into the housing 12' and the cover 13' of a pack 10' of the type shown in FIGS. 3*a* to 3*c*.

The weakened connecting portions 55 of the blank 23' are distributed in such a way that the sections 50 and 52 are located in the same manner as in the blank 23 of FIG. 2 but that the section 51' includes portions of the walls 15, 26 and a portion of the hinge 34. Thus, when the making of the pack 10' is completed and the label 60' is bonded to the housing 12' and cover 13, this label is again applied in such a way that it must be destroyed if the person holding the pack 10' wishes to gain access to cigarettes in the interior of the housing 12' As can be seen in FIG. 3*b*, the label 60' overlies portions of the walls 15, 16, 26 and 27. This label can be detached with the sections 50, 51', 52 (see FIG. 3*c*) upon destruction of certain portions of the connecting means 55.

Figure 3B:
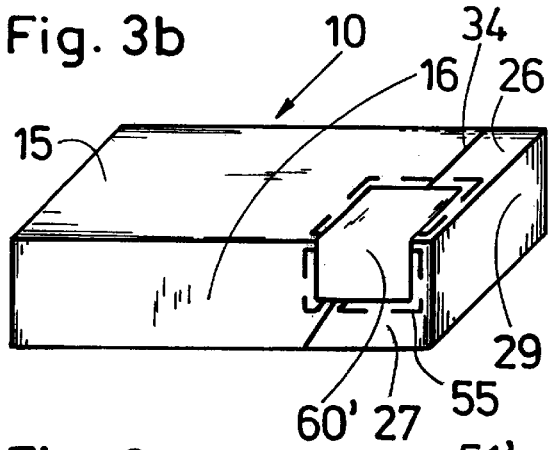
FIG. 3*b* illustrates the hinged-lid pack of FIG. 3*a* and a label adhesively bonded to the sections surrounded by the weakened portions shown in FIG. 3*a;*
Figure 3C:
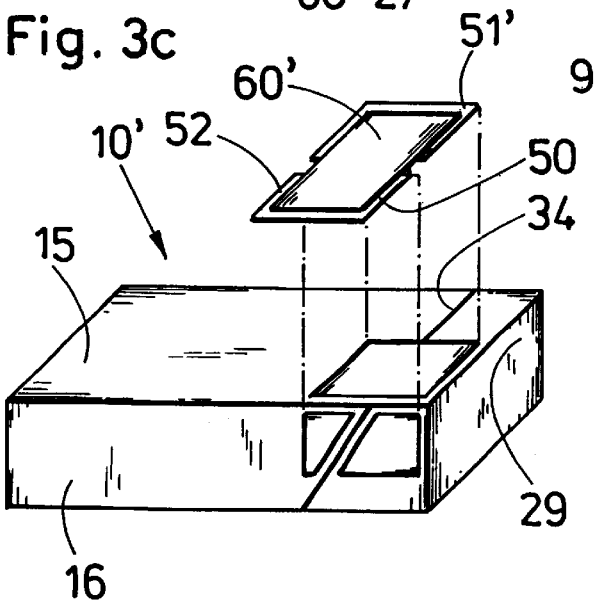
FIG. 3*c* illustrates the structure of FIG. 3*b* but with the label and the sections detached from the main portions of the housing-and cover and with the label flattened.
Figure 4:
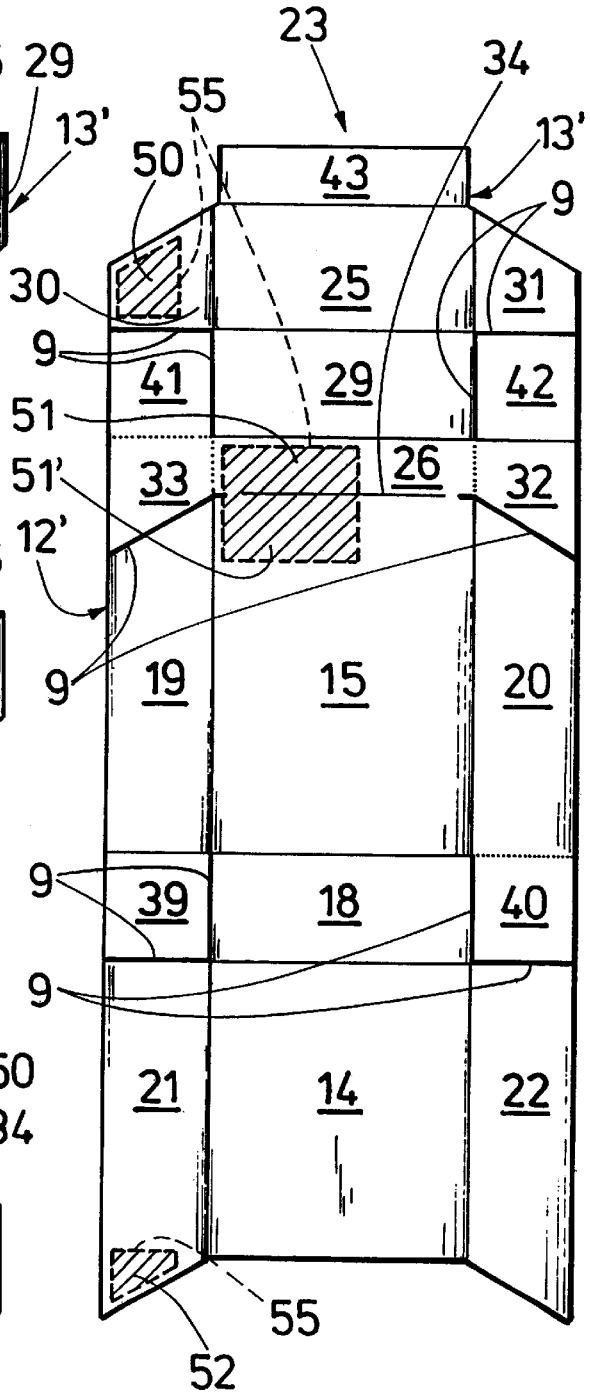
FIG. 4 is a plan view of a blank which can be converted into a hinged lid pack of the type shown in FIG. 3*a;*

FIG. 4 illustrates a blank 23' which can be converted into a hinged-lid pack 10' of the type shown in FIGS. 3*a* to 3*c*. FIG. 3*a* shows the converted blank 23' prior to the application of the label 60' to the external surfaces of the sections 50, 51' and 52. FIG. 3*b* shows that the applied label 60' overlies a portion of the hinge 34 but leaves exposed major parts of the composite portion including the perforated, slitted and/or otherwise weakened connecting means 55. FIG. 3*c* shows that the label 60' can be removed (with the sections 50, 51', 52) without any or any appreciable damage thereto. A portion of the label 60' overlies a portion of the hinge 34 prior to movement from the position of FIG. 3*b* to that shown in FIG. 3*c*.

Figure 5A:
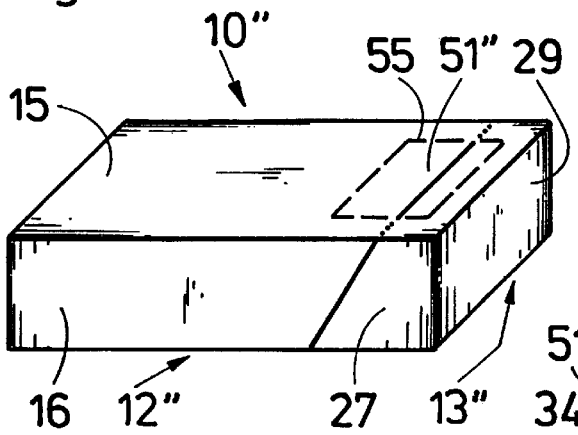
FIG. 5*a* is a perspective view of a hinged lid pack wherein the sections which are surrounded by weakened portions are provided only in the rear walls of the housing ad the cover.
Figure 5B:
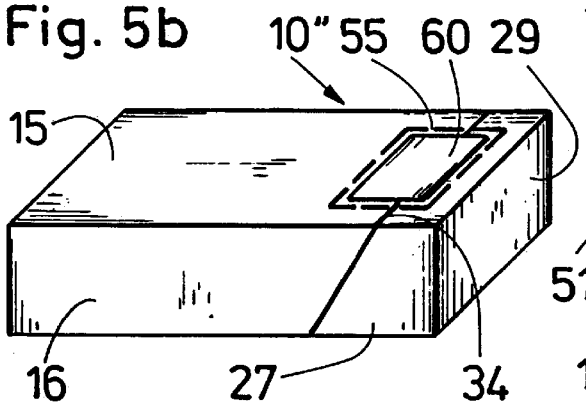
FIG. 5*b* illustrates the hinged-lid pack of FIG. 5*a* and a label or pad which is adhesively bonded to selected sections of the rear walls and extends across the hinge between the housing and the cover.
Figure 5C:
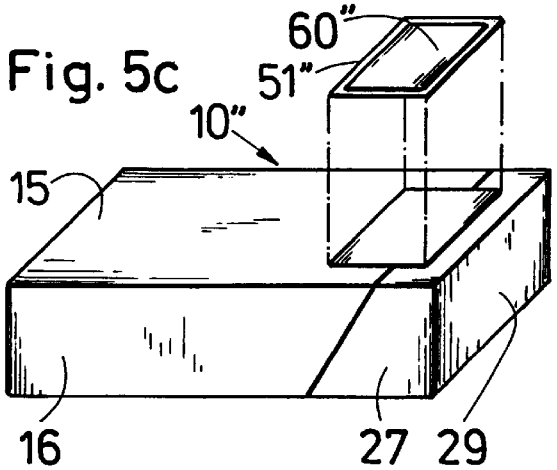
FIG. 5*c* illustrates the structure of FIG. 5*b* but with the label and the sections detached from the main portions of the housing and the cover.
Figure 6:
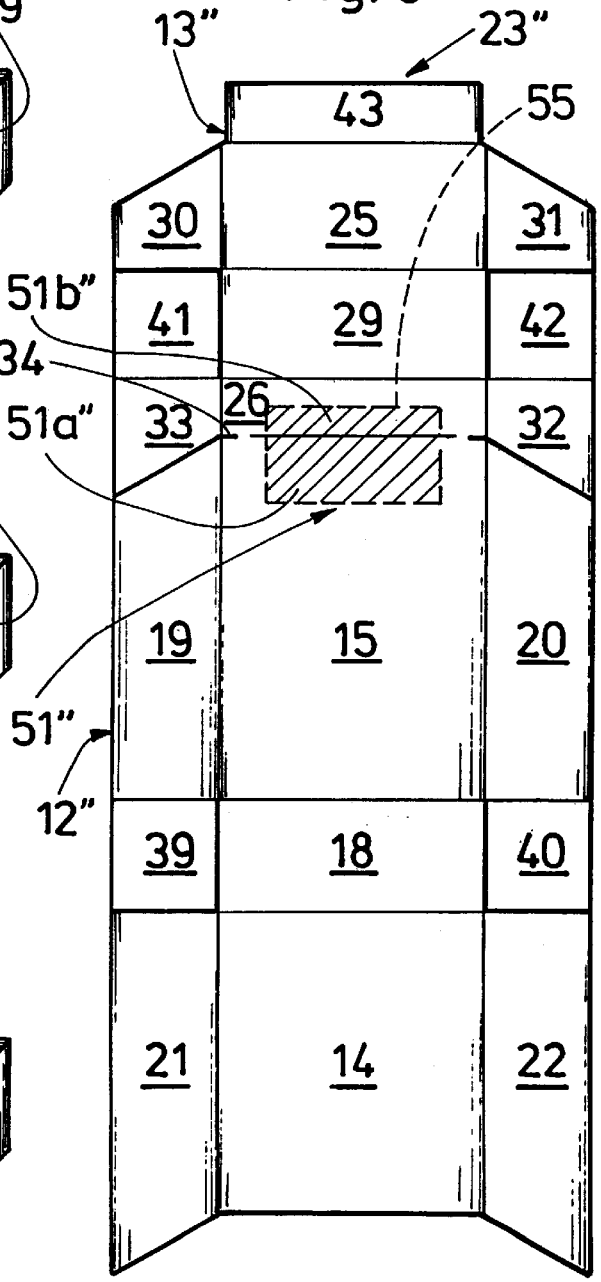
FIG. 6 is a plan view of a blank which can be converted into a hinged-lid pack of the type shown in FIG. 5*a*.

FIG. 6 shows a blank 23" which can be converted into a hinged-lid pack 10" of the type shown in FIGS. 5*a*, 5*b* and 5*c*. The reference characters employed in FIGS. 5*a* to 6 are similar or identical to those shown in FIGS. 1*a* to 2. The housing 12" and the cover 13" include neighboring portions 51", 51*b*" jointly constituting a composite portion 51" which is partially overlapped by an adhesive bearing label 60"; this label can be detached from the pack 10" jointly with the composite section 51" (see FIG. 5*c*) without any damage to such parts. In the absence of any additional sealing means which must be destroyed preparatory to or at the time of opening of the pack 10", this pack can be opened upon folding of the label 60" along a major portion of the hinge 34.

The adhesive which is utilized to bond the label 60" to the sections 51*a*", 51*b*" can but need not always be of the type which permits separation of such sections from the label 60" without any or without any appreciable damage to the latter.

Figure 7:
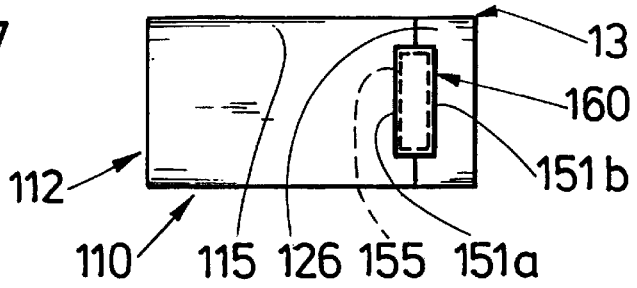
FIG. 7 is a plan view of a hinged-lid cigarette pack constituting a modification of the pack shown in FIG. 5*b*.

FIG. 7 is a plan view of a further hinged-lid pack 110 wherein the pad 160 overlies the sections 151*a*, 151*b* of the rear walls 115, 126 of the housing 112 and cover or lid 113 in such a way that all of the weakened connecting means or portions 155 are concealed (overlapped) by the label. This embodiment of the present invention exhibits the advantage that, if certain customers consider it advisable to conceal the weakened portions 155 (because, in the opinion of such customers, the visibility of such weakened portions detracts from the eye-pleasing appearance of the pack 110), such concealment is carried out in a simple and inexpensive but highly reliable manner.

One presently preferred method of making and mani pulating the improved box-shaped hinged-lid packs 10, 10', 10" and 110 can be practiced as follows:

The blank (such as 23) is provided with selected sections 50, 51, 52, i.e., with perforated and/or otherwise weakened connecting means 55, in such distribution that at least one section (52) forms part of the housing 12 and that at least one weakened section (50 and/or 51) forms part of the cover 13. The next step involves conversion of the blank 23 into a pack 10 which surrounds an array of, for example, twenty plain or filter cigarettes; such conversion can be carried out in the assignee's B 90 hinged-lid boxer. The label is thereupon caused to adhere to the exposed sides of the sections 50, 51 and 52 in such a way that it overlies at least some weakened connecting means 55 (e.g., in a manner as shown in FIGS. 1*b* and 1*c* if the selected label is identical with or an equivalent of the label 60). The next step involves a visual and/or automatic inspection of the pack 10 and, if warranted, segregation of the pack from other (satisfactory) packs.

The segregating step is followed by or takes place simultaneously with the step of removing the label 60 (with or without the section 50 and/or 51 and/or 52) from the housing 12 and cover 13 in such a way that the label remains at least partially intact, i.e., that the condition of the detached label is acceptable for presentation or delivery to the authorities in charge of crediting the maker of packs 10 with the sum amounting to or being prescribed for the return of labels 60 in a condition as required to substantiate the position that the respective pack did not leave the manufacturing plant for delivery to storage or to a distributor.

Predictable separation of the label 60 from the pack 10 shown in FIG. 1*b* can be assisted by the provision of at least one lug or any other suitable extension (handgrip portion) 70 on at least one of the sections 50, 51, 52. The exact size, shape and/or location of the handgrip portion 70 (and/or the number of such handgrip portions) can be selected practically at will. Automatic segregation tion of the label 60 (with or without the section 50, 51 and/or 52) from the housing 12 and cover 13 can be carried out by suitable pincers or the like which can be arranged to be actuated in response to advancement of the extension 70 to a predetermined location in the path leading to the locus for the gathering of acceptable packs 10.

An important advantage of the improved method, and of a pack which can be made and thereupon manipulated in accordance with such method, is that the label (such as 60) can be separated from a defective (unacceptable) hinged-lid pack in a condition which is acceptable to the aforementioned authorities, that the carrying out of the method does not involve expenditures which would render the recovery of labels too expensive, and that such method can be practiced in or in conjunction with existing packing machines upon relatively minor modifications of such machines.

One feature which is preferably exhibited by all embodiments of the present invention is the utilization of a one-piece label; this renders it possible to rapidly detach the label from the adjacent portions of the housing and of the cover as well as to detach the label in a manner such that the label remains intact or undergoes tolersble damage and is thus ready for presentation to authorities in order to seek a refund or credit. In addition, an intact or practically intact detached label can be readily stacked or otherwise assembled with similar labels in a small space.

It has been found that the separation of a label which is applied to a pack in such a way that it must be destroyed or defaced and/or otherwise affected in order to afford access to cigarettes is particularly convenient if the label adheres to those selected sections of the housing and of the cover which are adjacent each other in closed position of the cover. This can be seen in FIGS. 1*b*, 3*b*, 5*b* and 7.

It is further advisable to distribute the weakened connecting means (e.g., 55") in such a way that the sections which are provided in the cover of an assembled hinged-lid pack have end portions immediately adjacent end portions of weakened sections in the housing. This can be readily seen, for example, in FIG. 5*a* wherein two end portions of the U-shaped weakened connecting means 55" in the rear wall 15 are immediately adjacent the two end portions of the U-shaped weakened connecting means 55 in the rear wall 26 (see also FIG. 6). Such feature exhibits the advantage that a label (60") which has been bonded to the exposed surfaces of the sections 51a" and 51b" can be reliably separated from the housing 12" and from the cover 13" even if it was not bonded to the outer sides of the sections 51*a*", 51*b*" with utmost or high degree of accuracy. At the very least, the label 60" can be detached without any damage or without appreciable damage to its appearance and/or integrity. Such label can be detached with parts of or with the entire sections 51*a*", 51*b*".

The provision of sections (such as those shown at 51' in FIG. 3*a*) which exhibit a portion of the hinge 34 and/or of sections (such as 50, 52 shown in FIG. 1) which are immediately adjacent each other only when the cover (13) is held in the closed position also contributes to convenience of separation of a label (such as 60) in a relatively simple and time-saving manner as well as without any or any appreciable damage to the label.

The concealed (inner) side of the label 60, 60', 60" or 160 can be coated with adhesive in such a way that the adhesive cannot be seen when the application of the label to sections of the housing and cover is completed. As a rule, or at least in many instances, the adhesive is applied to and distributed on the label in such a way that it does not coat the external surface of the housing or cover outside of the respective weakened connecting section (such as 55).

It is further within the purview of the present invention to roughen the exposed sides of the sections 50–52, 51*a*", 51*b*" and/or 151*a*, 151*b* in order to ensure the establishment of a reliable adhesive bond between the housing and the cover on the one hand, and the separable section or sections on the other hand.

The weakening of the housing and/or cover as a result of the provision of perforated, slitted and/or otherwise treated portions 55, 155 to reduce their tearing strength can be (and preferably is) sufficiently pronounced to ensure that the application of relatively small pressure upon the respective-portion of the label 60, 60', 60" or 160 suffices to destroy the weakened portions and to thus greatly enhance the likelihood of separation of the label in a condition acceptable to the authorities for the payment of a refund or for the granting of adequate credit for all submitted (separated) labels.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making and manipulating receptacles for cigarettes and the like and, therefore, such adaptations should and are intended to be comprehended within the meaning and range of equivalence of the appended claims.

What is claimed is:

1. A receptacle for smokers' products, comprising:

a housing member having an opening;

a cover member, each of said members including a main portion, at least one section separable from the respective main portion and breakable means for connecting the main portion with the respective at least one section, said main portions and said sections having first tearing strengths and said connecting means having lesser second tearing strengths;

means for attaching said members to each other for movement of said cover member between first and second positions in which said cover member respectively closes and exposes said opening; and a pad overlying said sections, at least in the first position of said cover member, and being separable from said main portions together with said sections upon breakage of said connecting means.

2. The receptacle of claim 1, wherein said attaching means includes a hinge, each of said main portions including a front wall and a rear wall and said hinge pivotably connecting said rear walls to each other.

3. The receptacle of claim 1, wherein said pad comprises a single sheet.

4. The receptacle of claim 1, wherein said at least one section of said housing member is adjacent said at least one section of said cover member, at least in the first position of said cover member.

5. The receptacle of claim 1, wherein the connecting means of said cover member includes at least one end portion immediately adjacent an end portion of the connecting means of said housing member, at least in the first position of said cover member.

6. The receptacle of claim 1, wherein at least a portion of said attaching means means articulately connects said at least one section of said housing member with said at least one section of said cover member.

7. The receptacle of claim 1, wherein each of said main portions includes sidewalls, at least a portion of at least one section of at least one of said members being of one piece with one of said sidewalls, at least in the unbroken condition of the connecting means adjacent said at least one portion of said at least one section.

8. The receptacle of claim 1, wherein said main portion of said cover member includes a top wall and a rear wall, at least a portion of the at least one section of said cover member being coplanar with one of said walls at least in the first position of said cover member and in unbroken condition of the respective connecting means.

9. The receptacle of claim 1, wherein said main portion of said cover member includes a top wall and a sidewall, said at least one section of said cover member including first and second parts respectively coplanar with said top wall and said sidewall at least in the unbroken condition of the respective connecting means.

10. The receptacle of claim 1, wherein said pad is bonded to said sections.

11. The receptacle of claim 1, wherein said pad includes a coupon.

12. The receptacle of claim 1, wherein said pad includes a revenue label.

13. The receptacle of claim 1, wherein said pad overlies at least a portion of at least one of said connecting means.

14. The receptacle of claim 1, wherein said pad includes at least one of a revenue stamp, a revenue label, and a coupon, and said pad is seperable from the main portion without appreciable damaging the pad.

15. A method of making, and manipulating a substantially box-shaped receptacle for smokers' products, comprising the steps of:

providing a blank of foldable sheet material with at least one weakened portion at least partially surrounding at least one section of the blank;

thereupon converting the blank into a receptacle wherein a cover member is attached to a housing member for movement between closed and open positions in which the cover member respectively overlies and exposes an opening of the housing member and wherein the at least one section is accessible at an exterior of at least one of the members;

bonding a one-piece pad to the at least one section of the converted blank in the closed position of the cover member;

thereupon inspecting the quality of the receptacle; and detaching the pad from the receptacle, without appreciably damaging the pad, when the inspecting step reveals that the condition of the receptacle fails to meet a predetermined standard.

16. The method of claim 15, wherein said detaching step includes separating the pad from the receptacle together with the at least one section.

17. The method of claim 15, wherein the pad includes at least one revenue label.

18. The method of claim 15, wherein the pad includes at least one coupon.

19. The method of claim 15, wherein said detaching step includes one of manual and mechanical operations.

20. The method of claim 15, wherein said converting step includes transforming the blank into a receptacle wherein the at least one section forms part of the housing member as well as of the cover member.

21. The method of claim 15, wherein the bonding step includes causing the pad to overlie the entire at least one section and a portion of at least one of the housing and cover members adjacent the at least one section.

* * * * *